United States Patent [19]

Coffee

[11] 4,358,059

[45] Nov. 9, 1982

[54] ELECTROSTATIC SPRAYING

[75] Inventor: Ronald A. Coffee, Haslemere, England

[73] Assignee: Imperial Chemical Industries Limited, London, England

[21] Appl. No.: 203,624

[22] Filed: Nov. 3, 1980

[30] Foreign Application Priority Data

Nov. 19, 1979 [GB] United Kingdom ..... 7939951

[51] Int. Cl.[3] ..... B05B 5/02

[52] U.S. Cl. ..... 239/691

[58] Field of Search ..... 239/3, 690, 691, 696, 239/302, 702, 703, 704, 705, 706, 708, 377, 379; 361/235, 225, 227, 228; 174/50.5, 50.52, 50.53, 50.6; 427/4

[56] References Cited

U.S. PATENT DOCUMENTS 4,182,490 1/1980 Kennon ..... 239/691

4,241,880 12/1980 Hastings ..... 239/691

FOREIGN PATENT DOCUMENTS 1223451 6/1960 France .

1274875 5/1972 United Kingdom .

1552034 9/1979 United Kingdom .

OTHER PUBLICATIONS

Journal of Applied Physics, vol. 34 (1963), pp. 251–258.

*Primary Examiner*—James B. Marbert

*Attorney, Agent, or Firm*—Cushman, Darby & Cushman

[57] ABSTRACT

An electrostatic pump in an electrostatic sprayer is disclosed which comprises an ion injection electrode means disposed in a liquid conduit for conveying liquid to a sprayhead, downstream of the ion injection electrode is an ion discharge electrode means comprising an earthed ring, a potential difference is provided between the electrodes to provide hydrostatic pressure for conveying liquid in a conduit to the sprayhead.

5 Claims, 4 Drawing Figures

ELECTROSTATIC SPRAYING

This invention relates to electrostatic spraying, and particularly but not exclusively to the electrostatic spraying of agrochemicals, for example herbicides, insecticides and fungicides.

In our U.K. Patent No. 1569707, we have described an apparatus for the electrostatic spraying of liquids. This apparatus is of simple construction, with a low power requirement (it has no moving parts and can readily be run off dry cells); it is thus particularly suited for use as a hand held sprayer where large power sources are not readily available, e.g. in spraying crops. Electrostatic spraying of crops also has advantages in promoting even coating of plants with spray being attracted round behind foliage instead of coating only exposed surfaces; and in reducing spray drift, which is at best wasteful and at worst hazardous to the environment. Thus, although particularly suited for use as a hand held sprayer, the apparatus of U.K. Patent No. 1569707 may also usefully be mounted on vehicles such as tractors or aircraft, for the more convenient spraying of large quantities of liquid.

The apparatus disclosed in U.K. Patent No. 1569707 comprises essentially a discharge nozzle; an electrode disposed around the nozzle; a reservoir for supplying liquid to be sprayed to the nozzle; and a high voltage generator for applying a high voltage to the nozzle, the electrode being earthed. In this way, a strong electrical field may be produced between the nozzle and the electrode, sufficient to atomise liquid passing through the nozzle.

The device shown in U.K. Patent No. 1569707 delivers liquid to the spray-nozzle by gravity feed. This works well for applying small volumes of spray liquid from a hand held device (the apparatus is particularly well adapted for ultra-low volume spraying) but is less convenient where larger volumes have to be applied. Even with a hand held device, it is on occasion inconvenient to be obliged to hold the sprayer always in a position in which gravity can supply liquid to the nozzle; this can make it difficult, for example, to direct spray upwards. A more positive method of feeding liquid is thus desired.

Clearly, liquid may be fed to the sprayhead by means of mechanical pumps, operated either by hand or electrically. However, a hand operated pump tends to cause pressure fluctuations at the spray nozzle, with consequent irregularities in spray charging and deposition. Furthermore, it is hard work for the operator, who is perhaps already carrying a heavy spray tank on his back in a hot climate. Electrically-powered mechanical pumps need significantly more electrical energy than the most efficient electrostatic sprayers, and having moving parts are inherently likely to occasional breakdown.

We have now devised an electrostatic spraying system which at least partially overcomes the difficulties outlined above.

According to the present invention we provide an electrostatic sprayer comprising a sprayhead at which spray liquid is electrically charged and atomised, an electrically insulating conduit for conveying liquid to the sprayhead, an ion injection electrode mounted in the conduit, an ion discharge electrode in the conduit downstream of the ion injection electrode, and means to provide a potential difference between the two electrodes sufficient to produce hydrostatic pressure for conveying liquid in the conduit to the sprayhead. It is preferred that the sprayhead is of the kind comprising a nozzle which at least partly electrically conductive with a field-intensifying electrode adjacent thereto, with means for applying a high potential to the nozzle and for earthing the electrode.

Throughout this specification, the term "conductive" includes semi-conductive.

Voltages applied between the electrodes may conveniently be of the order of 10–25 kilovolts, though higher (e.g. 30 kilovolts) and lower (e.g. down to about 1 kilovolt) voltages may be used in certain circumstances.

The ion discharge electrode may be, or form part of, the sprayhead, or may be separate from it.

The gap between the ion injection electrode and the ion discharge electrode should be as short as possible consistent with avoiding arcing. The pressure obtainable from the pump is in general greater the smaller this distance. Thus, working with a highly resistive hydrocarbon liquid and a voltage of 25 KV, a gap of 1 millimeter gave a head of 35 cm of liquid, 1.5 millimeters a head of 15 cm of liquid and 3 millimeters a head of 5 cm of liquid. Arcing however interferes seriously with operation of the pump and once begun tends to be repeated.

Specific embodiments of the invention will now be described with reference to the drawings, in which.

Figure 1:
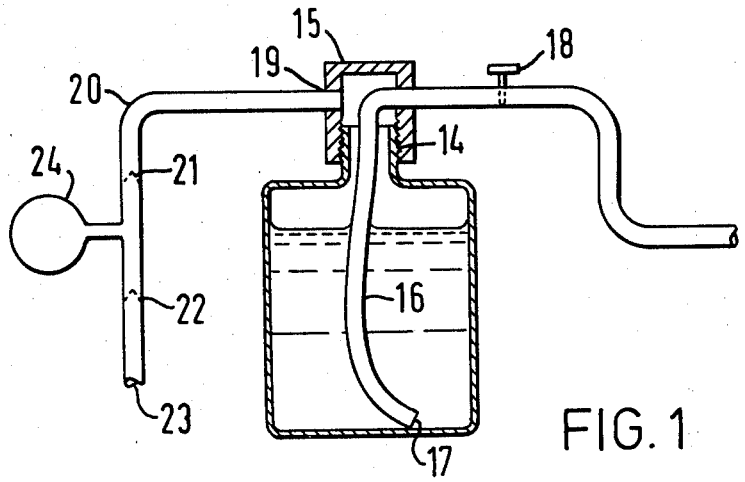
FIG. 1 is a vertical section through a reservoir and spraylines for use in the invention.
Figure 2:
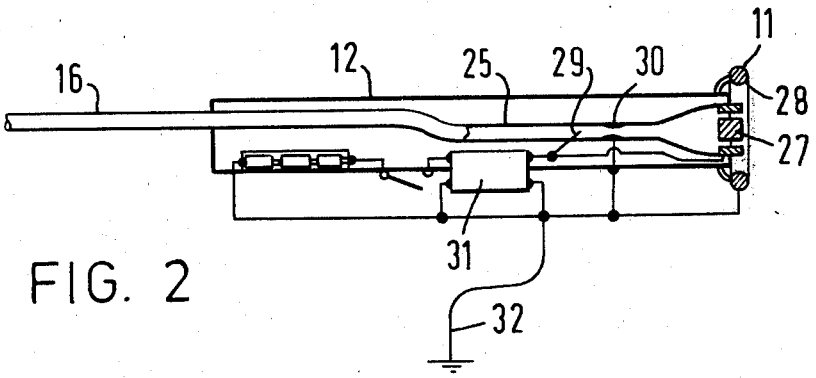
FIG. 2 is a diagrammatic representation of a sprayline and sprayhead according to the invention.

The first embodiment, shown in FIGS. 1 and 2, is a sprayer of the type comprising a spray reservoir 10, adapted to be carried on the back (a 'knapsack sprayer') which feeds a sprayhead 11 carried on a spraylance 12 via a flexible conduit 13. Referring in more detail to FIG. 1, the reservoir 10 is mounted via a screw fitting 14 to a coupling 15. The coupling 15 comprises a flexible tube 16, one end 17 of which extends to the base of the reservoir 10, and the other leads to the lance 12 via a tap 18. The coupling 15 also has an air vent 19, comprising a tube 20 having two non-return spring-biassed ball valves 21 and 22 leading to the atmosphere at 23. Between the two valves 21 and 22 the tube 20 communicates with a resilient closed rubber bulb 24. The flexible tube 16 joins the spray-lance 12, leading to a rigid insulating conduit 25 of plastics material (polypropylene). At the head of the conduit 25 is the sprayhead 11, consisting of an annular metal nozzle 27, the diameter of the annulus being about 10 mm and annular gap about 0.5 mm. Around and slightly forward of the nozzle 27 is a metal ring 28 about 50 mm in diameter. In the wall of the conduit 25 is a needle electrode 29; and about 2 mm from it, downstream towards the sprayhead 11, is a discharge electrode 30 in the form of a metal annulus round the inside of the conduit 25. A variable high voltage generator 31 (233P, 0–20 kilovolts, 200 microamp module, ex Brandenburg Limited), powered by flashlight batteries, is mounted on the spray-lance 12. One output terminal is connected to earth 32 (a trailing metal wire); the other is connected to the needle electrode 29, and to the nozzle 27. The discharge electrode 30 and the metal ring 28 are both earthed.

In operation, the reservoir 10 is filled with spray liquid (comprising a 5% solution of an insecticide in a liquid aromatic hydrocarbon), screwed on the coupling 15 and the tap 18 opened. The sprayer is then primed by squeezing the rubber bulb 24 gently, forcing air into the reservoir 10, until spray liquid begins to emerge from the nozzle 27. The generator 31 is then turned on. This generates a powerful electrostatic field between the charged nozzle 27 and the earthed ring 28 functioning as a field intensifying electrode; and liquid emerging from the nozzle is charged and atomised by this field and projected outwards as a fine spray of charged particles. At the same time, the needle electrode 29 discharges ions into the spray liquid. These ions are repelled from the electrode 29 and attracted towards the earthed discharge electrode 30; they therefore move to the electrode 30 to be discharged, pulling the liquid along with them. This creates sufficient pressure to withdraw spray liquid from the reservoir 10 and convey it to the sprayhead 11.

Figure 3:
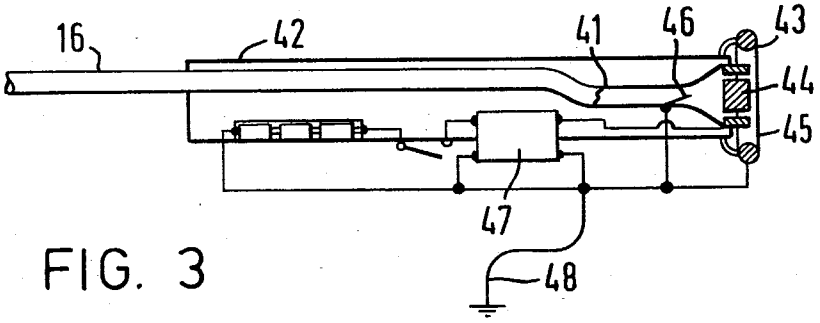
FIG. 3 is a diagrammatic representation of a second sprayline and sprayhead according to the invention.

A second embodiment of the invention, having no separate discharge electrode, is illustrated in FIGS. 1 and 3. The reservoir 10 and tube 16 in this embodiment are connected via a tap 40 to a tube 41 in a lance 42, terminating in a sprayhead 43 comprising a metal nozzle 44 and metal ring 45 of the kind described in connection with FIG. 2. There is a needle electrode 46 as before, but this is placed much closer to the metal nozzle 44 and there is no separate discharge electrode. The high voltage generator 47 (of the same type as before) has an output terminal connected to the nozzle 44, the other being connected to earth 48; the needle electrode 46 and the metal ring 45 are both earthed.

The device is operated in the same way as the first embodiment. When the high voltage generator 47 is turned on, the charge on the metal nozzle 44 induces a charge of opposite sign on the earthed needle electrode 46, and this injects ions into the liquid. These are attracted to the nozzle 44, where they are discharged, the spray liquid is charged by contact in the opposite sense, and sprayed as before. Generally however, the pressures and flow-rates obtainable are not so high as when a high potential is applied directly to the ion injection electrode.

Various modifications to the above apparatus will be apparent to those skilled in the art. For example, the device, instead of being hand held, may be mounted on a tractor, train or aircraft. The ion injection electrode, instead of being in the form of a needle, may have a sharp edge (for example, like the edge of a razor blade), or may take the form of a fine wire. The discharge electrode may be, for example, in the form of a coarse metal gauze across the conduit or a metal tube of lesser diameter than the conduit disposed co-axially within the conduit. If desired, both electrodes may be of the same form, e.g. sharp or pointed, though this is much less efficient. In such cases, ions will be injected into the liquid at both electrodes, and discharged at both electrodes; the resulting pressure may depend on one electrode being a more efficient ion injector than the other, or on a different type of ion being formed at each electrode. The shape of the conduit between the two electrodes may affect the pump performance. We have found that it is sometimes advantageous to reduce the cross-section of the conduit from the injection electrode to the discharge electrode, either gradually or sharply. This can increase the pumping effect. The earth need not be a trailing metal wire, which can become entangled or trip people up; it may be through the operator. A strip of conductive material on the lance which the operator holds will provide a pathway to earth which, though of high resistance, is often sufficient for the purposes of the invention.

Containers for use with the device may be of the type described in U.K. Applications Nos. 2030060 and 7937697 and incorporating electrical connections necessary to complete the electrical circuitry, as a precaution against misuse or battery waste. Such containers may comprise the electrical energy source (e.g. dry cells) to power the high voltage generator.

Devices of the type described do not work well with highly conductive or highly resistive liquids. To spray satisfactorily from the devices illustrated, a liquid resistivity of about $10^6$–$10^{10}$ ohm centimeters (at 20° C.) is generally preferred. The pumping mechanism works better, however, the higher the resistivity of the liquid; at lower resistivities, perhaps because electron transfer at least partially replaces physical movement of ions, the pumping effect is reduced proportionately. At resistivities below about $10^8$ ohm centimeters, it is difficult to obtain a consistent pumping effect; for this reason, it is convenient to use liquids having a resistivity of about $10^9$ ohms, since these both pump and spray most satisfactorily. Liquids should not be too mobile or too viscous.

If it is required to generate a higher operating pressure without unduly increasing the voltage, more than one pair (for example, two to ten pairs) of ion injection and discharge electrodes may be used in series.

Figure 4:
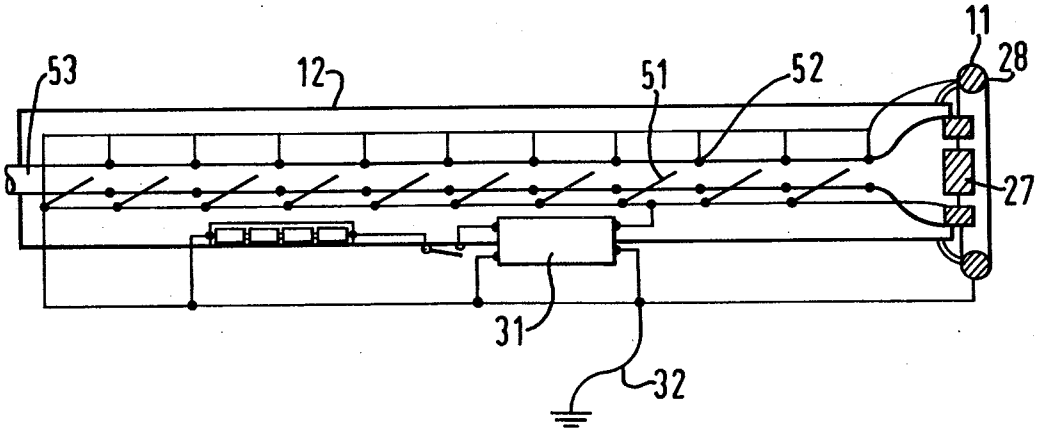
FIG. 4 is a diagrammatic representation of a third sprayline and sprayhead according to the invention.

A further embodiment of the invention, with 10 pairs of injection electrodes 51 and discharge electrodes 52 mounted in a tube 53, is illustrated in FIG. 4. Here the arrangement of nozzle 27, generator 31, etc. is just as shown in FIG. 2. The tube 53 is 3 mm in diameter. Using the arrangement shown in FIG. 4 to spray hydrocarbon liquid of resistivity about $10^9$ ohm centimeters, with applied voltages in the range 10–25 kilovolts, a flow rate of about 1 ml/second up a vertical rise of 1 to 2 meters may be obtained.

The ion pump partially compensates for pressure variations in liquid delivered to it, thereby exerting a smoothing effect on the flow rate of liquid emerging from it. If desired, this smoothing effect may be accentuated still further by suitable feedback, e.g. pressure or flow rate sensing means downstream of the pump linked to the voltage supply to the pump electrodes, and arranged to increase the voltage in response to a decrease in pressure or flow rate, and vice versa.

I claim:

1. An electrostatic sprayer comprising a sprayhead at which spray liquid is electrically charged and atomised, an electrically insulating conduit for conveying liquid to the sprayhead, an ion injection electrode means mounted in the conduit for injecting ions into the liquid, an ion discharge electrode means mounted in the conduit downstream of the ion injection electrode for discharging said ions, and means for providing a potential difference between the two electrodes sufficient to produce hydrostatic pressure for conveying liquid in the conduit to the sprayhead.

2. A sprayhead as claimed in claim 1, comprising a nozzle which is at least partly electrically conductive with a field intensifying electrode adjacent thereto, with means for applying a high potential to the nozzle and for earthing the electrode.

3. A sprayhead as claimed in either of claims 1 or 2, which comprises more than one pair of ion injection and ion discharge electrode means, in series.

4. A sprayhead as recited in claims 1 or 2 wherein said means for providing a potential difference between the two electrodes includes means for earthing said ion discharge electrode means.

5. A sprayhead as recited in claim 2 wherein said field intensifying electrode comprises an earthed ring.

* * * * *